United States Patent [19]

Hemmeter

[11] 4,017,919

[45] Apr. 19, 1977

[54] MATTRESS GUARD

[76] Inventor: John H. Hemmeter, 128 Sterling Lane, Wilmette, Ill. 60091

[22] Filed: Feb. 12, 1976

[21] Appl. No.: 657,493

[52] U.S. Cl. ..... 5/317 R; 5/331

[51] Int. Cl.[2] ..... A47C 22/00

[58] Field of Search ..... 5/193, 317, 320, 322, 5/331; 206/513, 821; 312/140; 108/55; 211/49 R, 440; 297/445; 403/230, 235

[56] References Cited

UNITED STATES PATENTS

| | | | |
|---|---|---|---|
| 2,154,557 | 4/1939 | Bechik | 5/332 |
| 3,253,860 | 5/1966 | Shapiro | 297/440 |
| 3,354,515 | 11/1967 | Robinson | 206/821 |
| 3,385,615 | 5/1968 | Hussey | 403/235 |
| 3,474,473 | 10/1969 | Hannaberg | 5/331 |
| 3,774,967 | 11/1973 | Rowland | 297/445 |

*Primary Examiner*—Casmir A. Nunberg
*Attorney, Agent, or Firm*—Hill, Gross, Simpson, Van Santen, Steadman, Chiara & Simpson

[57] ABSTRACT

A guard constructed of plastic-clad wire has a horizontal portion captured beneath the corner of a box spring, and vertical portions extending upwardly adjacent the sides of the box spring and a mattress lying thereon. The vertical portions prevent the mattress from sliding over the edges of the box spring at the corner; use of four such guards, one at each corner, immobilizes the mattress and keeps it properly aligned with the box spring. A brace portion is affixed over the box spring to clamp the guard to the box spring and to stiffen the vertical portions of the guard. A second horizontal portion is formed about the corner of the mattress between the ends of the vertical portions to further stiffen the assembly and to assist in retaining the mattress in position.

6 Claims, 4 Drawing Figures

MATTRESS GUARD

BACKGROUND OF THE INVENTION

1. Field of the Invention

The present invention relates to devices for holding a mattress in position upon a box spring, aligning it therewith.

2. The Prior Art

Various devices have been employed for grasping mattresses and holding them down or in an appropriate position. U.S. Pat. No. 809,049 discloses a mattress holder for a folding bed, wherein a wire device grasps a wire network beneath the mattress and clamps the mattress thereto by one or two arms. U.S. Pat. No. 2,701,884 discloses a mattress holding device wherein a double-ended hook grasps the bed frame on one side and a loop fixed in the mattress on the other side, the loop being spaced inwardly from the edge of the mattress.

SUMMARY OF THE INVENTION

A simple corner-positioned mattress guard is formed from a spring wire or similar material preferably having a protective coating, such as plastic, thereon. Two vertical portions extend upwardly adjacent the sides of the box spring and the mattress at the corners thereof to align the mattress with the box spring. These vertical portions are held in position by a horizontal portion which extends from a lower end of one of the vertical portions, beneath the box spring, and through a right-angle bend to the lower end of the other vertical portion. The horizontal portion is thus captured between the box spring and its support and by acting upon the bottom of the box spring prevents the vertical portions from rotating from their vertical positions. A brace portion is arranged to overlie the upper surface of the box spring, attaching to the vertical portions by snap joints. The brace assists in clamping the mattress guard to the box spring and in supporting the two vertical portions with respect to one another. At the upper ends of the vertical portions a second horizontal portion may be employed to bear against the corner of the mattress, following the corner contour of the mattress to provide additional bearing surface to restrain shifting of the mattress. One such mattress guard at each corner of the mattress and box spring assembly will align the mattress squarely with the box spring and restrain slipping under movement stresses imposed by users of the bed.

DESCRIPTION OF THE PREFERRED EMBODIMENTS

Figure 1:
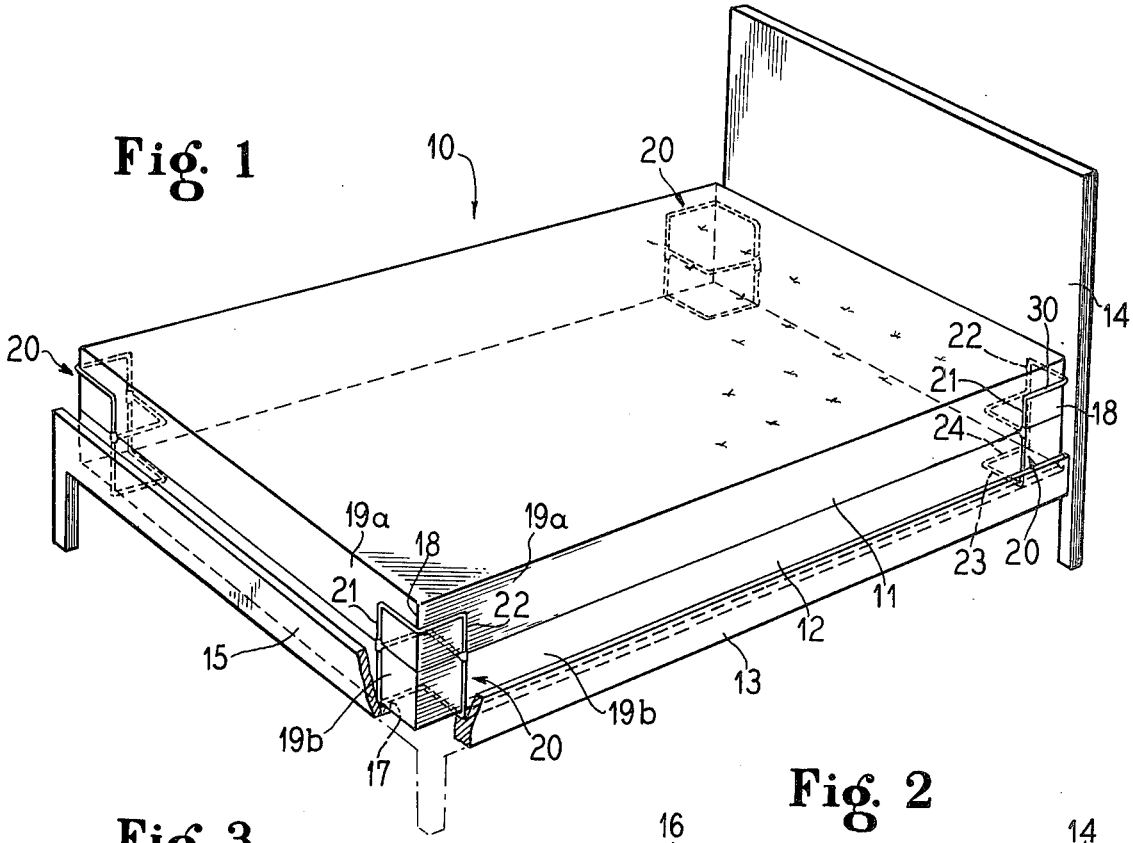
FIG. 1 is a general perspective view, partially cut away, of a mattress and box spring set employing the guards of the present invention.

A conventional bed is shown generally at 10 in FIG. 1, comprising a mattress 11 which rests upon a box spring 12. The box spring 12 is supported at least along its longitudinal edges upon bed rails 13 which join a head board 14 and foot board 15 together in a conventional manner. The head board 14 and foot board 15 may have supporting ledges 16 and 17, respectively, formed thereon to support the transverse edges of the box spring 12. The box spring 12 is conventionally of inner-sprung construction upon a wooden framework which gives rigidity thereto along the four lower edges thereof. The mattress 11 may be of inner spring, foam rubber, or other conventional construction.

In accordance with the principles of the present invention, the mattress and box spring set 10 is provided at each corner 18 thereof with a mattress guard 20 which maintains the mattress 11 in proper relative position atop the box spring 12. The mattress guards 20 are captured and braced between the box spring 12 and the supporting rails and boards and ledges 13, 14, 15, 16, 17 and align respective sides **19*a* of the mattress 11 with sides 19*b* of the box spring 12**.

Figure 3:
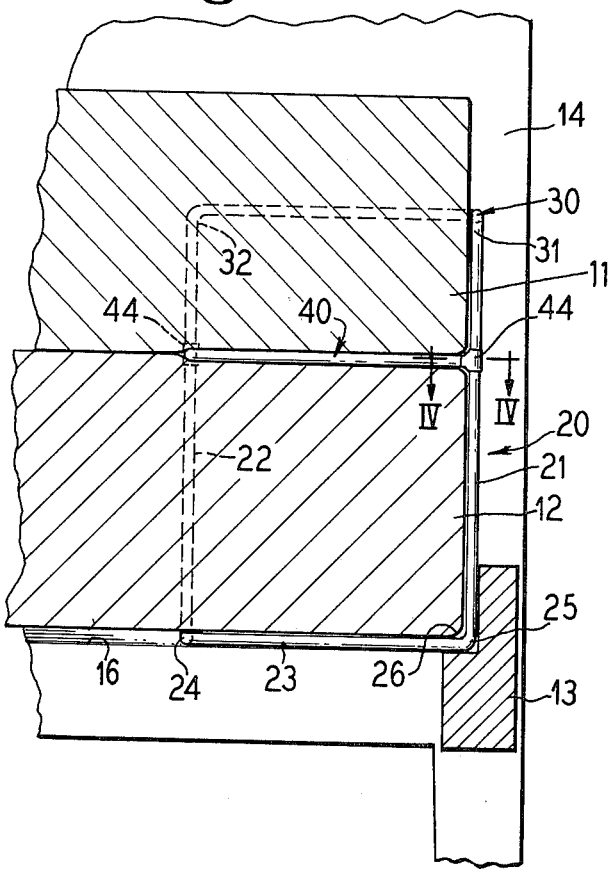
FIG. 3 is a sectional view through the mattress and box spring assembly of FIG. 1, taken on line III—III of FIG. 2.
Figure 4:
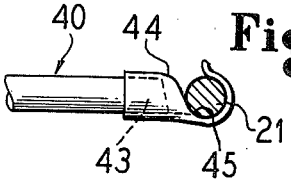
FIG. 4 is a detailed view of a snap connection, taken on line IV—IV of FIG. 3.

Each of the mattress guards 20 principally comprises a pair of vertical portions 21, 22 and a pair of corresponding horizontal arms 23 and 24. The vertical portion 21 is attached to the first horizontal arm 23 at a right angle bend 25, as shown in FIG. 3. The portion 22 is similarly connected to the arm 24, and the arms 23 and 24 join at a right-angle intersection spaced inwardly from the sides **19*b* of the box spring. The mattress guard 20 is held in place by the capture of the horizontal arms 23 and 24 at the right angle bends 25 between a lower edge 26 of the box spring 12 and the bed rail 13 and between such edge 26 and any ledges 16 and 17 of the head board 14 and foot board 15. Each vertical portion 21 and 22 of the guard 20 is held closely to the sides 19*b* of the box spring by vertical portions of the edge rails 13, the head board 14, and the foot board 15** adjacent the horizontal support ledges.

The mattress guard 20 is preferably constructed from a steel rod or tube of approximately ¼-inch in diameter and is coated with a vinyl plastic. The steel wire or rod has sufficient transverse rigidity to maintain the vertical portions 21 and 22 straight and in perpendicular relation to the horizontal arms 23 and 24. Thus, since the horizontal arms 23 and 24 are each constrained from rotating about the bends 25 by the underside of the box spring 21, the mattress 11 is constrained from sliding to the right in the orientation of FIG. 3 by the vertical portion 21 of the mattress guard 20. That is, the horizontal arm 23 acts as a lever to prevent rotational displacement of the upper part of the vertical portion 21. The vertical portions of the edge rails 13 and boards 14 and 15 prevent sideward movement of the lower parts of the portions 21 and 22. Since, as shown in FIG. 1, four mattress guards 20 are provided, the mattress 11 is thus prevented from moving in any of four directions with respect to the box spring 12.

Figure 2:
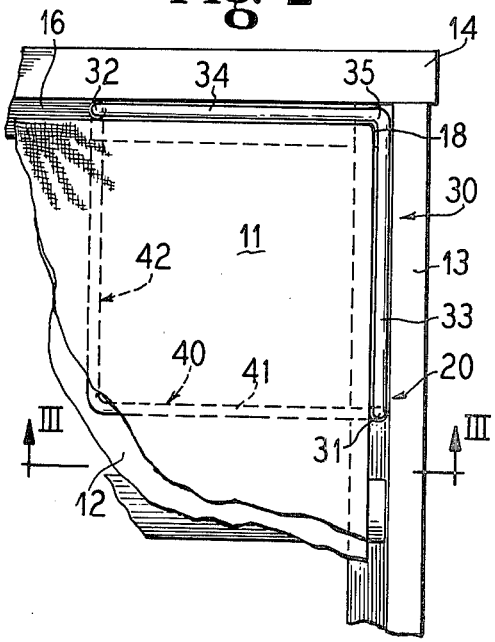
FIG. 2 is a top plan view of a corner of the mattress and box spring assembly and a mattress guard of FIG. 1.

Also in accordance with the principles of the present invention, a second horizontal portion 30 is optionally connected between upper ends 31, 32 of the vertical portions 21, 22, respectively. The second horizontal portion 30 comprises first and second arm portions 33 and 34, which join together at a corner 35 adjacent the corner of the mattress 18, as shown in FIG. 2. The arms 33 and 34 strengthen the mattress guard 20 and provide additional bearing surface against the sides **19*a* of the mattress 11 by which the mattress 11 is retained in its position against horizontal slippage. Such additional surface is especially useful to constrain foam mattresses. The second horizontal portion 30 is preferably constructed of the same ¼-inch metal tube or rod as the vertical portions 21 and 22 and the lower horizontal portion 23 and 24; in fact, the entire assembly 20** is preferably provided in one continuous piece.

It is also a feature of the present invention that a brace piece 40 is provided between the mattress 11 and the box spring 12, having the same general shape as the lower horizontal portions 23 and 24 but spaced vertically thereabove and engaging the vertical portions 21 and 22 midway along the lengths thereof. Thus, the brace portion 40 comprises first and second arms 41 and 42, which may be formed of the same material as the rest of the guard but need not have a vinyl coating thereon. It is intended that the brace portions 40 be continuously adjustable vertically along the vertical portions 21 and 22, in order to be snugly fitted to the top of any box spring 12. For this purpose each 43 of the brace portion 40 is provided with a snap fitting 44. Each fitting 44 has a hook portion 45 arranged transversely of the plane of the brace portion 40 formed by the arms 41 and 42 thereof, for grasping one of the vertical portions 21 and 22. Each connector 44 also has an appreciable vertical width to help increase the rigidity of the mattress guard 20 as against bending of the vertical arms 21 and 22.

It is of course possible to vary the configuration of the mattress guards 20 without altering the novel function thereof. For instance, the horizontal arm portions 23 and 24 could comprise a rounded or sweeping arc between the points of attachment to the vertical portions 21 and 22, with only slight if any loss in stiffness compared to the structure shown in the drawings with the greater lever arm lengths. It is also possible to dispense with the second horizontal arms 30, since the vertical portions 21 and 22 provide resistance to lateral movement of the mattress 11 with respect to the box spring 12. In this configuration, the upper ends 31 and 32 of the vertical portions 21 and 22 would simply be smoothly capped or rounded to avoid snagging of bed clothes. It is also possible to construct the mattress guards 20 of a flat material rather than a cylindrical one as herein disclosed, without sacrificing any of the inventive features hereof. Similarly, it is possible to dispense with the bracing portion 40. However, the brace 40 is desirable, and in cases where a hollywood type frame is encountered in which the box spring is unsupported at the foot end, the brace 40 will supply the major mattress retention force. Although these and other minor modifications will be suggested by those skilled in the art, it should be understood that I wish to embody within the scope of the patent warranted hereon all such modifications as reasonably and properly come within the scope of my contribution to the art. Further, in the use of the device, headboard configuration may be such as to eliminate need for mattress stabilization except at the foot of the bed, in which case 2, rather than 4, devices may be employed.

I claim as my invention;

1. A mattress guard for aligning a mattress with a box spring thereunder, each of said mattress and box spring having vertical sides and corners, and said box spring having at least two edges resting upon a support thereunder, the guard comprising:

a horizontal portion adapted to be captured between said box spring and said support thereof at one of said corners of said box spring, said horizontal portion extending beneath said box spring from a first side to a second, adjacent side thereof; and a pair of vertical portions secured at lower ends thereof to said horizontal portion at said first and second sides of said box spring, each of said vertical portions extending upwardly to ends adjacent said sides of the mattress, whereby said guard prevents said mattress from slipping outwardly past either of said first and second sides of said box spring at said corner.

2. A mattress guard as defined in claim 1, further comprising a second horizontal portion extending between said upper ends of said vertical portions about the sides and corner of said mattress, following the contour thereof.

3. A mattress guard as defined in claim 1, further comprising a brace portion having ends engaging each of said vertical portions at points aligned with an upper surface of said box spring, said brace portion extending between said brace ends parallel to said horizontal portion and capturing said box spring between said brace portion and said horizontal portion.

4. A mattress guard as defined in claim 3, wherein said brace portion further comprises snap-joints at each end thereof, each said snap joint being adapted to engage one of said vertical portions at any point therealong in snug perpendicular relationship thereto.

5. A mattress guard for aligning a mattress with a box spring lying thereunder, the mattress and the box spring having corresponding sides and corners and the box spring having lower edges resting upon a support located thereunder, the guard comprising:

a horizontal portion adapted to be captured between said box spring and said support, said horizontal portion comprising first and second arms joined together at a midpoint thereof and each extending transversely to respective first and second sides of said box spring adjacent a corner between said sides;

a pair of vertical portions each extending from a rigid joint with said first and second arms of said horizontal portion and parallel to a respective side of said box spring to a point adjacent said side of said mattress; and a brace portion adapted to be received between said box spring and said mattress, comprising a pair of snap joint members, one engageable with each of said vertical portions, and a spanning member extending between said joint members.

thereby to prevent said mattress from shifting position with respect to said box spring and past either of said first and second sides thereof at said corner.

6. A mattress guard as defined in claim 5, further comprising a second horizontal portion extending between said points at upper ends of the vertical portions along said sides of said mattress and about the corner therebetween.

* * * * *